United States Patent [19]

Caruso

[11] Patent Number: 5,005,829

[45] Date of Patent: Apr. 9, 1991

[54] EXERCISE MACHINE FOR PATIENTS CONFINED TO BED

[76] Inventor: Anthony A. Caruso, 1130 Commodore Dr., Clearwater, Fla. 34643

[21] Appl. No.: 436,168

[22] Filed: Nov. 14, 1989

[51] Int. Cl.[5] ..... A63B 21/00

[52] U.S. Cl. ..... 272/130; 272/900; 128/25 R

[58] Field of Search ..... 272/130, 900, 93, 73, 272/72, DIG. 4, 132, 134; 128/25 R

[56] References Cited

U.S. PATENT DOCUMENTS 3,693,614 9/1972 Schon ..... 128/25 R
4,488,719 12/1984 Brown ..... 272/72
4,550,907 11/1985 Melillo et al. ..... 272/900
4,925,184 5/1990 McJunkin, Jr. et al. ..... 272/900

*Primary Examiner*—Stephen R. Crow
*Attorney, Agent, or Firm*—Joseph C. Mason, Jr.; Ronald E. Smith

[57] ABSTRACT

An exercising device usable by patients confined to a bed. The device has a cantilevered construction and thus positions the active exercise elements within easy reach of the patient. A pair of handles that are pivotally mounted for opposite direction pivotal movement may be manipulated by the patient's hands or feet so that the patient may exercise all four limbs. The amount of resistance that is presented by the device may be varied by changing the angular orientation of resistance members that are associated with each handle, and the device is lockable to the patient's bed so that it is held against movement during the exercise period.

17 Claims, 5 Drawing Sheets

EXERCISE MACHINE FOR PATIENTS CONFINED TO BED

TECHNICAL FIELD

This invention relates, generally, to exercise machines. More particularly, it relates to a machine usable by persons who are unable to leave a bed to obtain exercise.

BACKGROUND ART

Most exercise machines require that the exerciser stand up when using the device, lie down on the device, or sit thereupon. Thus, most exercise devices are built with the assumption that the exerciser is already able-bodied and merely desires to enhance his or her physical abilities.

Accordingly, people confined to wheel chairs or beds are generally excluded from enjoying the benefits of conventional exercise equipment. The present inventor earlier developed an exercise device for persons confined to wheelchairs whereby the individual need not leave the wheelchair to enjoy physical exercise, but the need for an exercise device for bedridden patients remains unfulfilled.

DISCLOSURE OF THE INVENTION

The long-standing but heretofore unfulfilled need for an exercise machine for bedridden patients is now fulfilled by an apparatus having a longitudinally extending base part that rolls on wheels and that fits under a bed; the apparatus locks onto the footboard of the bed to prevent its movement during the exercise period. An upstanding column is fixedly secured to an end of the device that is not positioned under the bed, and a horizontally disposed arm member surmounts the column and extends in cantilevered fashion therefrom in a longitudinally extending direction so that the free end of the arm is near the head of the bed.

A pair of handle members are pivotally mounted to opposite sides of the arm member, near its free end, and are oriented in a vertical plane; the patient reciprocates the handle members in opposite directions with his or her hands or his or her feet.

A resistance member is interconnected between each handle and the arm member and the amount of resistance offered by each resistance member is dependent upon its angular orientation with respect to a horizontal plane, i.e., the smaller the angle, the greater the resistance.

A transversely disposed bell crank member is pivotally secured to an underside of the arm member and a stabilizing link member is positioned in interconnecting relation between each handle member and opposite ends of the bell crank member. More specifically, a first stabilizing link member is pivotally secured at its trailing end to a first end of said bell crank member, and a second stabilizing link member is pivotally secured at its trailing end to an opposite or second end of said bell crank member. Thus, the bell crank member reciprocates in a horizontal plane about its pivotal connections to said stabilizing link members as the patient opposingly reciprocates the handles in a vertical plane.

The cantilevered arm is of telescopic construction so that the position of the handle members can be longitudinally adjusted to the most comfortable position for the patient. A locking means is provided to lock the arm into position once it has been positioned as desired.

It is therefore apparent that a primary object of this invention is to provide an exercise machine for the benefit of persons confined to a bed.

Another important object is to provide such an exercising machine that enables the exerciser to exercise the arms or legs as desired.

Still another object is to provide such a machine having an adjustable resistance means so that the exerciser or a therapist can adjust the amount of resistance to an optimal level.

A more general object is to provide an exercising machine that is of elegant construction so that it occupies very little space when locked onto a bed.

Another general object is to provide such a machine that is light-in-weight and easy to assembly.

Additional objects will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
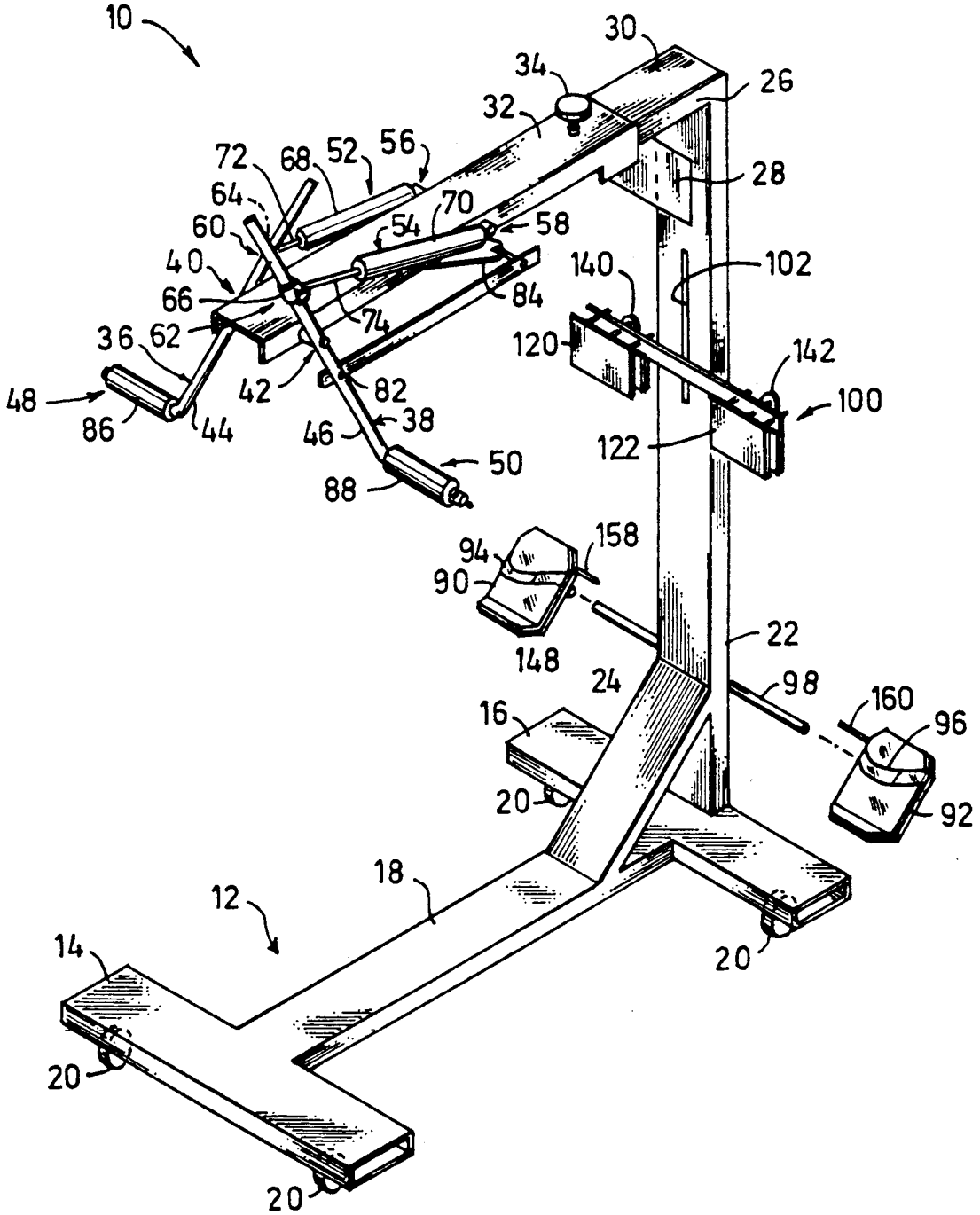
FIG. 1 is a perspective view, with a couple of exploded parts, of an illustrative embodiment of the novel exercise machine.

Referring now to FIG. 1, it will there be seen that an illustrative embodiment of the invention is denoted by the reference numeral 10 as a whole.

Machine 10 includes a "H"-shaped base 12 that includes forward transverse part 14 and rearward transverse part 16 interconnected by longitudinal part 18. Suitable roller members, collectively denoted 20, facilitate rolling transportation of machine 10 over a support surface such as a floor, not shown in FIG. 1.

An upstanding column member 22 is fixedly secured to the trailing edge of rearward base part 16, and a brace member 24 is angularly disposed between said column 22 and part 18 of base member 12.

A longitudinally extending arm member 26 surmounts column 22 and extends therefrom in cantilevered relation thereto. An angularly disposed brace member 28 interconnects column 22 and arm 26 and performs the function its name implies. Teflon TM pad 30 overlies arm 26 along its entire extent.

Another longitudinally extending arm member 32 telescopically engages arm member 26; it has a channel-shaped cross section as shown. A set screw 34 is tightened against Teflon pad 30 to hold arm 32 in a preselected position of longitudinal adjustment.

A pair of generally "L"-shaped handle members 36, 38 are pivotally mounted to opposite sides of arm 32 near its forwardmost end as generally indicated by the reference numerals 40, 42, respectively. Each handle member 36, 38 includes a first elongate, vertically aligned main part 44, 46 and a horizontally aligned minor part 48, 50 bent orthogonally thereto; the minor parts 48, 50 serve as hand or foot grips and extend transversely in opposite directions to one another as shown.

A pair of resistance elements, generally denoted 52, 54, are pivotally mounted, at their respectively trailing ends, to arm 32, as denoted by numerals 56, 58. The leading or forward end 60, 62 of each element 52, 54 is adjustably secured by collar members 64, 66, only one of which is shown, to vertical part 44, 46 of handles 36, 38, respectively.

Each resistance element 52, 54 includes a cylindrical part 68, 70 and a plunger part 72, 74 that is co-axial with said cylindrical part and which is slideably received therein. The amount of resistance supplied by each element 52, 54 depends upon the length of travel of plungers 72, 74 with respect to cylinders 68, 70, respectively; accordingly, the amount of resistance depends upon the positioning of collar members 64, 66 along the extend of handle parts 44, 46. More particularly, the resistance increases as the distance between collar members 64, 66 and pivot points 40, 42 increases, respectively.

When machine 10 is assembled, handles 36, 38 are positioned in an orientation such as shown in FIG. 1, i.e., one of the handles is placed in its forwardmost position and the other handle is placed in its rearwardmost position, i.e., one plunger 72 or 74 is fully retracted and the other plunger is fully extended, and the collar members 64, 66 are positioned equidistantly from pivot points 40, 42, respectively. Thus, a patient may oscillate hand or foot grips 48, 50 in opposite directions to obtain the benefits of exercise.

FIG. 1 also depicts means for stabilizing the handles during such oscillation. A pair of linear-in-configuration stabilizing link members 76, 78, only one of which is shown in FIG. 1, have their respective leading ends pivotally secured to handle parts 44, 46 as at 80, 82. The trailing end of each link member 76, 78 is pivotally secured to a bell crank member 84 that is pivotally secured at its fulcrum to the bottom of arm 32. Thus, as depicted in FIG. 1, when handle 36 is in its forwardmost position and handle 38 is in its rearwardmost position, bell crank 84 will be sharply angled with respect to arm 32 as depicted.

When the patient or therapist decides that the patient's upper body is in need of exercise, cylindrical hand grips 86, 88 of soft foam construction are slide fit over parts 48, 50 of the handle members and the patient reciprocates the handles in opposite directions. If lower body exercise is desired, foot support members 90, 92 are slide fit onto said parts 48, 50 in lieu of hand grips 86, 88, and straps 94, 96 are employed to secure the patient's feet thereto. When not in use, foot support members 90, 92 are preferably stored on cross bar member 98 that is fixedly secured to column 22.

A clamp member, denoted 100 as a whole, secures machine 10 to the footboard of a bed, not shown in FIG. 1. Vertically extending slot means 102 is formed in column 22 to enable placing clamp 102 in a plurality of functional positions of vertical adjustment so that machine 10 can be secured to footboards of differing heights. Importantly, when clamp 100 is securely engaged to a footboard, machine 10 is securely held against movement as the patient exercises.

Figure 2:
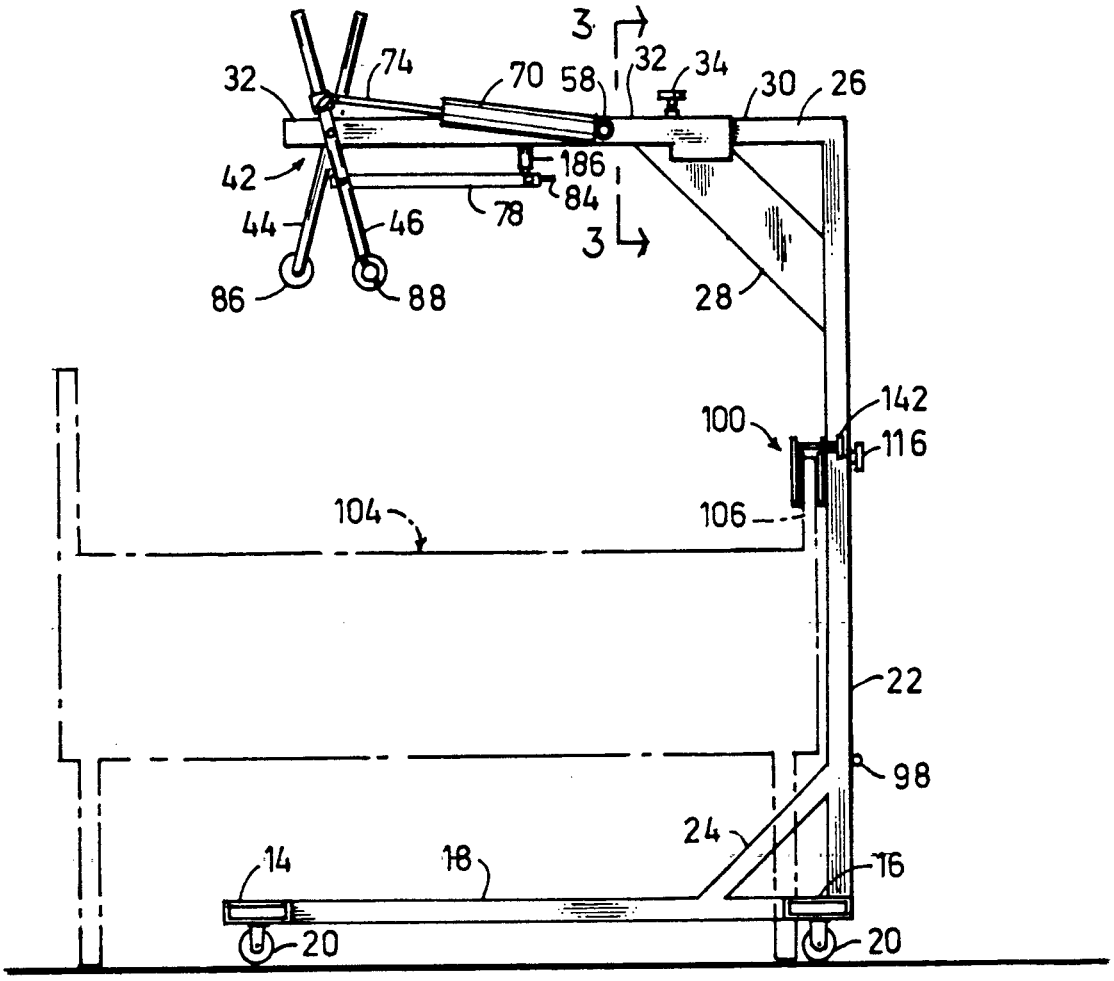
FIG. 2 is a side elevational view of the machine shown in FIG. 1.

FIG. 2 shows the proper positioning of machine 10 with respect to a bed 104. Clamp 100 is shown in its gripping relation to footboard 106.

Figure 3:
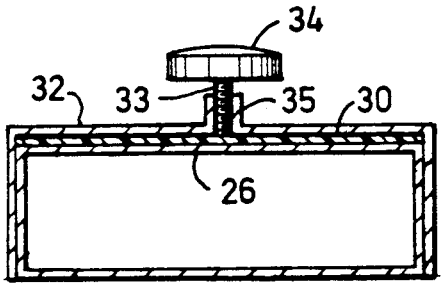
FIG. 3 is a transverse sectional view taken along line 3—3 in FIG. 2.

FIG. 3 shows how set screw 34 includes stud 33 that screw threadedly engages boss means 35 which projects from arm 32; it also depicts the distal end of said screw 33 bearing against Teflon pad 30 to prevent relative movement between telescoping arms 26 and 32.

Figure 4:
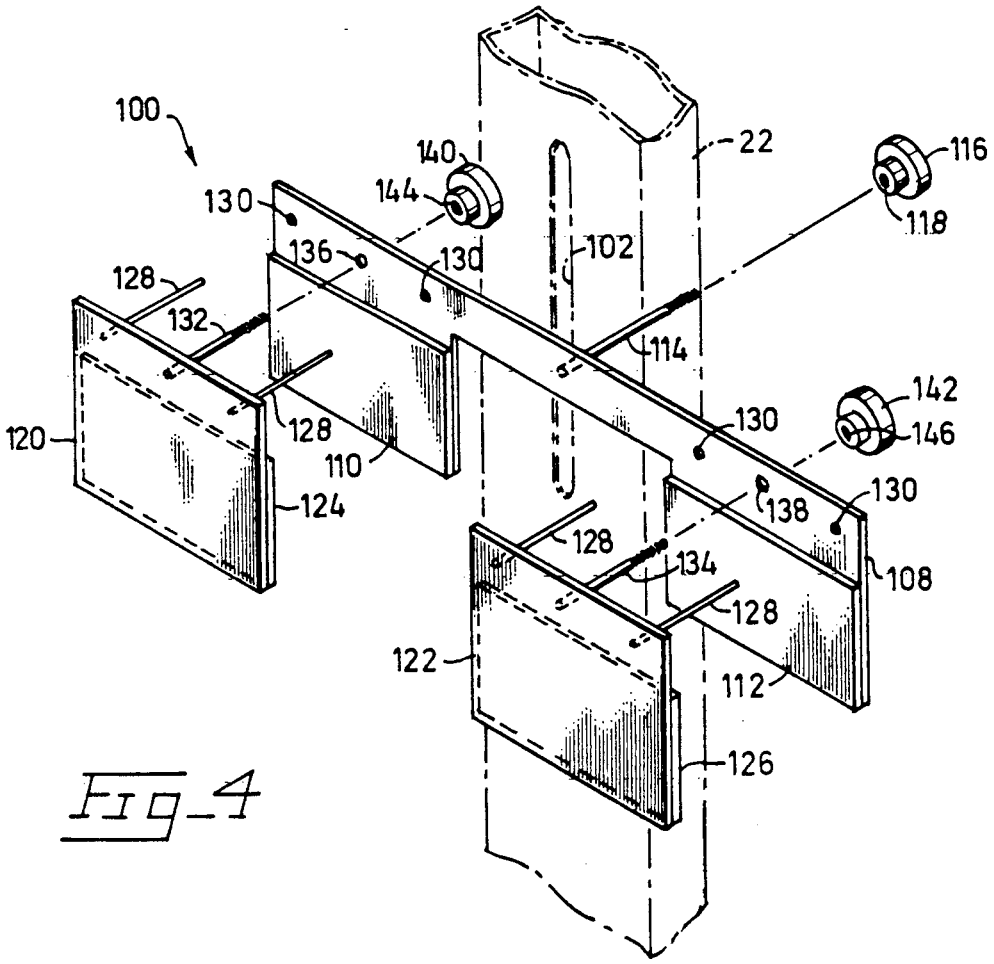
FIG. 4 is an exploded perspective view of the mechanism that releasably locks the machine onto a footboard.

Footboard clamp 100 is depicted in greater detail in FIG. 4. Transversely mounted, flat base member 108 has Teflon pads, 110, 112 fixedly secured to its opposite ends. Elongate bolt 114 is secured to base member 108 mid-length thereof and projects orthogonally therefrom through slot means 102 as depicted; its threaded free end is screw threadedly engaged by knob member 116. Knob 116 includes boss part 118 that bears against column 22 when said knob is rotated to maintain clamp member 100 in a preselected position relative to said column 22.

Laterally spaced apart plate members 120, 122 carry Teflon pad members 124, 126 as shown. When clamp 100 is fully tightened against footboard 106 as shown in FIG. 2, spaced apart parts of said footboard are sandwiched between pads 110, 124 and 112, 126, respectively. The pads prevent marring of the footboard and enhance the grip achieved as well.

Each plate 120, 122 carries a pair of guide rod members, collectively denoted 128, that extend through apertures 130 formed in base member 108. The guide rod members flank central bolt member 132, 134 that extends through apertures 136, 138, respectively; the distal free end of each bolt 132, 134 is threaded and screw threadedly receives knob members having boss means 144, 146, respectively, that bear against base member 108 when said knobs 140, 142 are rotated. The rotation draws plates 120, 122 toward base plate 108 to achieve a tight sandwiching grip of footboard 106.

Figure 5:
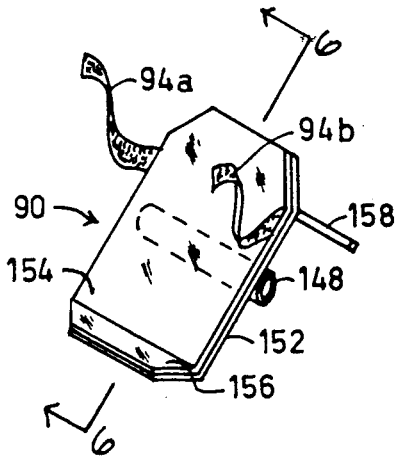
FIG. 5 is a perspective view of a foot support member that is used when the machine is configured as a leg exercising device.
Figure 6:
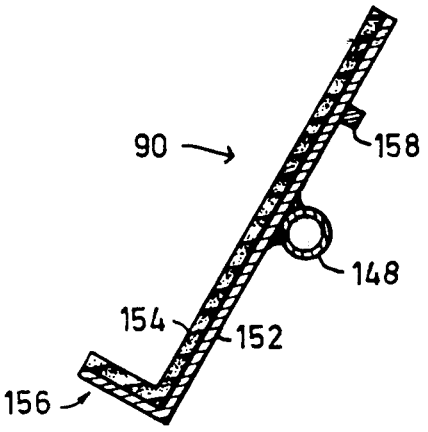
FIG. 6 is a longitudinal sectional view taken along line 6—6 in FIG. 7.

Foot support member 90 is shown in greater detail in FIGS. 5 and 6. Strap 94 is now understood to include straps 94*a*, 94*b*, of complimentary Velcro TM construction. Tubular piece 148 is slide fit over handle 48 (FIG. 1) in lieu of cylindrical pad member 86 to secure foot support member 90 to said handle 48 and a similar tubular member 150 (FIG. 7) is slide fit over handle 50 (FIG. 1) in lieu of pad member 88 to secure foot pad member 92 (FIG. 7) to said handle 50.

Foot support member 90, as perhaps best understood in conjunction with FIG. 6, includes as "L"-shaped base part 152 and a complementally formed cushioned pad member 154 disposed in overlying relation thereto. The bent part 156 of member 90 prevents the patient's foot from sliding from said support member.

Stop bar 158 bears against vertical part 44 of handle 36 when foot support member 90 is engaged to handle part 48; similarly, stop bar 160 (FIGS. 1 and 7) of foot support member 92 bears against vertical part 46 of handle 38 when said foot support member is in use. Stop bars 158, 160 prevent rotation of their respective foot support members 90, 92, about their respective mounts 48, 50.

Figure 7:
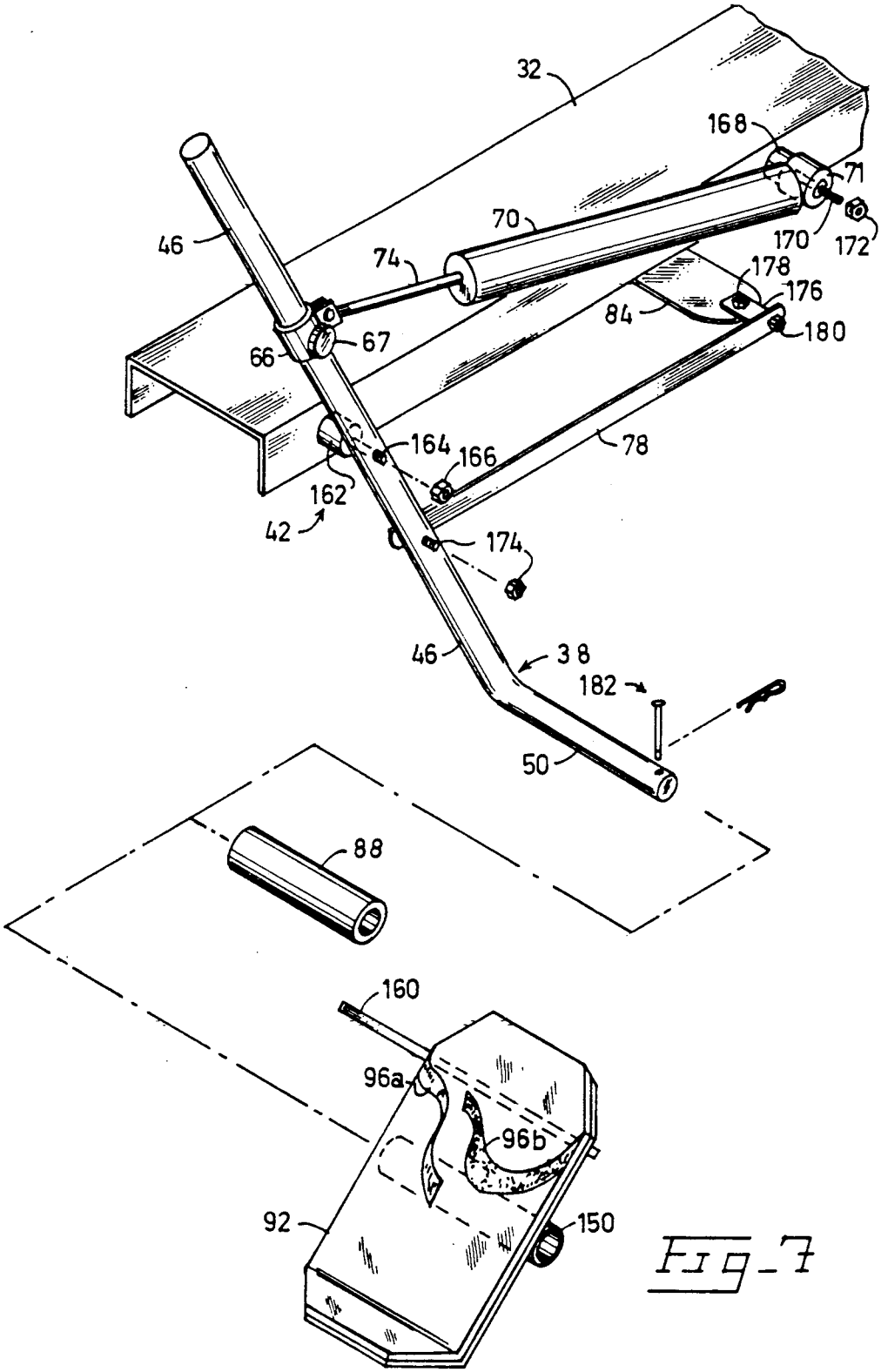
FIG. 7 is an exploded perspective view showing certain details of construction and indicating the interchangeability of the hand grips and the foot supporting members.

FIG. 7 perhaps best depicts the interchangeability of hand grips 86, 88 and foot support member 90, 92, respectively. The upper part of that FIG. also depicts an additional number of details of construction of the stabilizing assembly and the resistance elements. For example, collar member 66 is now seen to include a set screw 67 that permits its facile adjustment along the extend of part 46. Moreover, the pivotal connection 42 between handle 38 and telescoping arm 32 is now seen to include a Teflon bushing 162 that carries stud 164 that extends through a bore formed in said part 46; nut 166 screw threadedly engages stud 164 and completes the pivotal mounting of said handle 38.

The pivotal connection of the trailing end of resistance element 70 is also best seen in FIG. 7. Element 70 includes an integral base 71; Teflon bushing 168, which is fixedly secured to the side of arm 32, carries stud 170 that extends through a bore means formed in said base 71 of resistance element 70. Nut 172 prevents retraction of stud 170 into said bore means and hence pivotally secures the trailing end of resistance element 70 to the side of arm 32.

The leading end of stabilizing link member 78 is pivotally secured to handle part 46 by a nut and bolt assembly denoted 174 as a whole. The trailing end of link 78 is pivotally secured to bell crank 84 by a right angled bracket member 176; the horizontal part of bracket member 176 is pivotally secured to the bell crank 84 by a nut and bolt assembly 178 and the vertical part of said bracket member 176 is pivotally secured to link member 78 by a nut and bolt assembly 180.

The final structural detail shown in FIG. 7 is the cotter pin assembly, denoted 182, generally, that retains either the hand grips 86, 88 or the foot support members 90, 92 in place.

Figure 8:
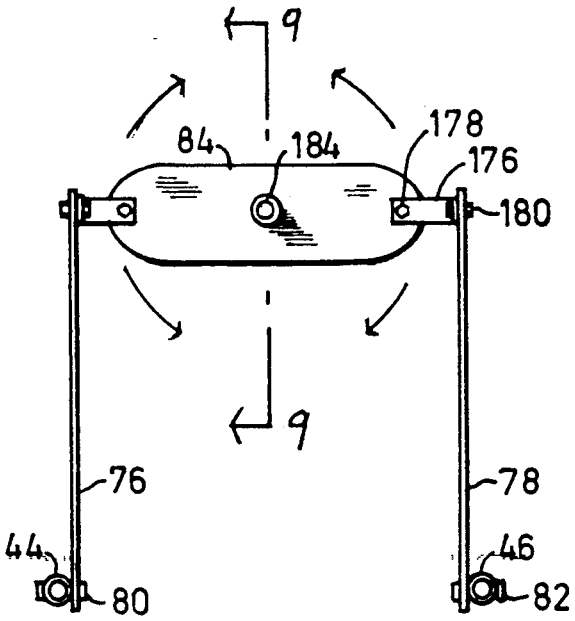
FIG. 8 is a plan view of the bell crank member and the stabilizing link members.

The bell crank 84 is shown in full in FIG. 8; it is rotatable in a horizontal plane about its fulcrum 184 in the directions indicated by the directional arrows appearing in FIG. 8.

Figure 9:
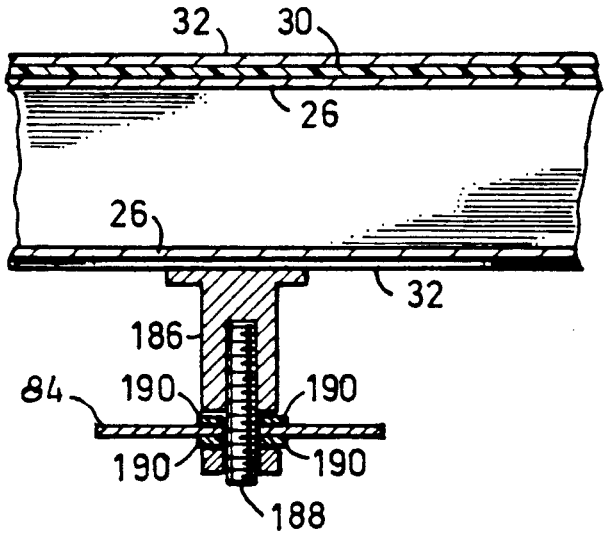
FIG. 9 is a longitudinal sectional view taken along line 9—9 in FIG. 8.

FIG. 9 depicts how bell crank 84 is pivotally mounted to the bottom side of arm 32. Cylindrical spacer 186 is fixedly secured by suitable means to the bottom side of telescoping arm 32 as depicted and depends therefrom. Spacer 186 carries stud 188 which screw threadedly engages a complementally threaded aperture means formed in said bell crank 84 at the center thereof. Plural Teflon bushings 190 reduce the friction at the point of interconnection.

Those skilled in the art of machine design will readily appreciate that different but still suitable bushings, fastening means, spacers and the like could be employed to interconnect the several parts of the machine. Moreover, parts such as the clamp member 100 that engages the footboard could be made in many different ways. This description has merely set forth a preferred embodiment of the invention, but the claims that follow are not restricted to specific details of construction.

It will thus be seen that the objects set forth above, and those made apparent from the foregoing description, are efficiently attained and since certain changes may be made in the above construction without departing from the scope of the invention, it is intended that all matters contained in the foregoing description of shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said fall therebetween.

Now that the invention has been described, what is claimed is:

1. An exercise device for persons confined to a bed, comprising:

a base member configured to fit under a bed;

an upstanding column member secured to said base member;

a substantially horizontal arm member disposed in cantilevered relation to said column member;

a pair of handle members;

said handle members being pivotally mounted to opposite sides of said arm member for reciprocation in a substantially vertical plane;

resistance means disposed in interconnecting relation between each of said handle members and said arm member, said resistance means being disposed on opposite sides of said arm member;

locking means for locking said device to a bed when in use ;and a handle member stabilizing means including a bell crank member pivotally secured to an underside of said arm member, and a pair of stabilizing link members, each link member in said pair of stabilizing link members being disposed in interconnecting relation between each handle member and said bell crank member on opposite sides of said arm member for maintaining said handles in a substantially vertical plane.

2. The device of claim 1, wherein said arm member includes a first stationary part fixedly secured to said column member, a second part disposed in telescoping relation thereto, and a locking means for selectively locking said second part into any preselected position of telescoping adjustment.

3. The device of claim 2, wherein said handle members, resistance means and stabilizing link members are mounted to said second part of said arm member.

4. The device of claim 3, wherein each of said resistance means includes a resistance element having a cylindrical housing and a co-axial plunger member slideably movable in relation thereto.

5. The device of claim 4, further comprising a collar member connected to a leading end of each plunger member, and each collar member being securable to an associated handle member at any preselected position along the extend thereof that is upwardly of a point where said handle member is pivotally secured to said arm member.

6. The device of claim 5, wherein each of said stabilizing link members has a leading end pivotally secured to an associated handle member at a preselected point that is below the point where said handle member is pivotally secured to said arm member.

7. The device of claim 6, wherein each of said stabilizing link members has a trailing end pivotally secured to an end of said bell crank member.

8. The device of claim 7, wherein said bell crank member is linear-in-configuration and is mounted for oscillation in a horizontal plane.

9. The device of claim 8, further comprising a pair of bracket members of right angled configuration disposed in interconnecting relation between opposite ends of said bell crank member and a trailing end of an associated stabilizing link member, each member in said pair of bracket members having a horizontal part pivotally secured to said bell crank member and a vertical part pivotally secured to an associated stabilizing link member.

10. The device of claim 1, wherein said locking means includes a footboard clamp member that includes opposing plate members between which a footboard is disposed in sandwiched relation, and means for tightening said opposing plate members to said footboard.

11. The device of claim 10, wherein said footboard clamp member is vertically adjustable to accommodate footboards of varying heights.

12. The device of claim 11, further comprising a vertically extending slot means, of predetermined extent, formed in said column member, and said footboard clamp member being selectively mountable at any predetermined position along the extend of said slot means.

13. The device of claim 1, wherein said handle members have a generally "L"-shaped configuration, wherein an elongate part of said handle members is mounted for oscillation in a vertical plane, and wherein a transversely extending truncate part of each of said handle members is disposed in a horizontal plane.

14. The device of claim 13, further comprising a cushioned hand grip member releaseably and selectively attachable to said truncate part of said handle members to provide a comfortable gripping surface for an exerciser's hands.

15. The device of claim 14, further comprising a foot support member releaseably and selectively attachable to said truncate part of said handle members, strap means associated with each of said foot support members to releaseably retain an exerciser's foot to an associated foot support member, and a transversely extending stop means disposed in overlying relation to said elongate part of an associated handle member to limit rotation of said foot support member about said transversely extending truncate part of an associated handle member.

16. The device of claim 15, further comprising a transversely extending cross bar member fixedly secured to said column member, said hand grip members and said foot support members being selectively mountable to said cross bar member when not in use.

17. The device of claim 16, further comprising a plurality of rotatably mounted wheel members for supporting said base member so that said base member is transportable over a support surface and easily positionable under a bed.

* * * * *